United States Patent [19]

Lindskoug

[11] 4,267,696

[45] May 19, 1981

[54] HOT GAS ENGINE

[75] Inventor: Per S. Lindskoug, Skanor, Sweden

[73] Assignee: Kommanditbolaget United Stirling AB & Co., Malmo, Sweden

[21] Appl. No.: 12,120

[22] Filed: Feb. 14, 1979

[51] Int. Cl.[3] ..... F02G 1/04

[52] U.S. Cl. ..... 60/526; 165/51; 165/78

[58] Field of Search ..... 60/517, 526; 165/51, 165/78

[56] References Cited

U.S. PATENT DOCUMENTS 2,963,871 12/1960 Meijer ..... 165/51 X

*Primary Examiner*—Allen M. Ostrager

*Attorney, Agent, or Firm*—Finnegan, Henderson, Farabow, Garrett & Dunner

[57] ABSTRACT

The crankcase, monoblock assembly and engine block of a hot gas engine are fixedly interconnected by a locking pin having a cold gas connecting duct. The hot gas engine is comprised of a plurality of monoblock assemblies, each assembly including a cylinder, a heater pipe system and a regenerator-cooler housing. The locking pin passes through bores formed in the regenerator-cooler housing and a cooler unit received therein and includes a cold gas connecting duct which provides communication between the cylinder and the regenerator-cooler housing.

10 Claims, 2 Drawing Figures

HOT GAS ENGINE

BACKGROUND OF THE INVENTION

1. Field of the Invention

The invention is directed to a hot gas engine in which which a crankcase and a monoblock assembly (comprising a cylinder, a heater pipe system and a regenerator-cooler housing) are detachably connected to an engine block. More particularly, the invention is directed to a locking pin passing through transverse bores in the regenerator-cooler housing, the cooler unit and the engine block for fixedly interconnecting the monoblock to the engine block.

2. Description of the Prior Art

Hot gas engines operate at substantially high mean gas pressures and at substantially different temperature extremes, including high maximum gas temperatures. The elements of a hot gas engine which contain or seal the working gases are therefore exposed to high thermal and mechanical stresses. These elements, which are made of rather costly materials, should be made as light as possible for both economic and structural reasons. Past engine designs have not provided the most advantageous and economical means for containing the working gas charges.

SUMMARY OF THE INVENTION

The object of the invention is to provide a hot gas engine in which a monoblock assembly (comprising a cylinder, a heater pipe system and a regenerator-cooling housing), an engine block and a crankcase are detachably interconnected in such a manner that practically no other elements are required to contain the working gas.

To achieve the objects and in accordance with the purpose of the invention, as embodied and broadly described herein, the invention is directed to an improvement in a hot gas engine having a monoblock assembly including a cylinder, a heater pipe system and a regenerator-cooler housing, the monoblock assembly being detachably connected to a crankcase, the improvement in the monoblock assembly comprising transversely directed, coaxial bores formed in the regenerator-cooler housing and a cooler unit received therein and a locking pin passing through the bores and locking the regenerator-cooler housing relative to the cooler unit, and a cold gas connecting duct in the locking pin for providing communication between the cylinder and the regenerator-cooler housing.

It is understood that both the foregoing general description and the following detailed description are exemplary and explanatory only and are not restrictive of the invention, as claimed.

The accompanying drawings, which are incorporated in and constitute a part of the specification illustrate one embodiment of the invention and, together with the description, serve to explain the principles of the invention.

DESCRIPTION OF THE PREFERRED EMBODIMENTS

Reference will now be made in detail to the present preferred embodiments of the invention, the examples of which are illustrated in the accompanying drawings.

Figure 1:
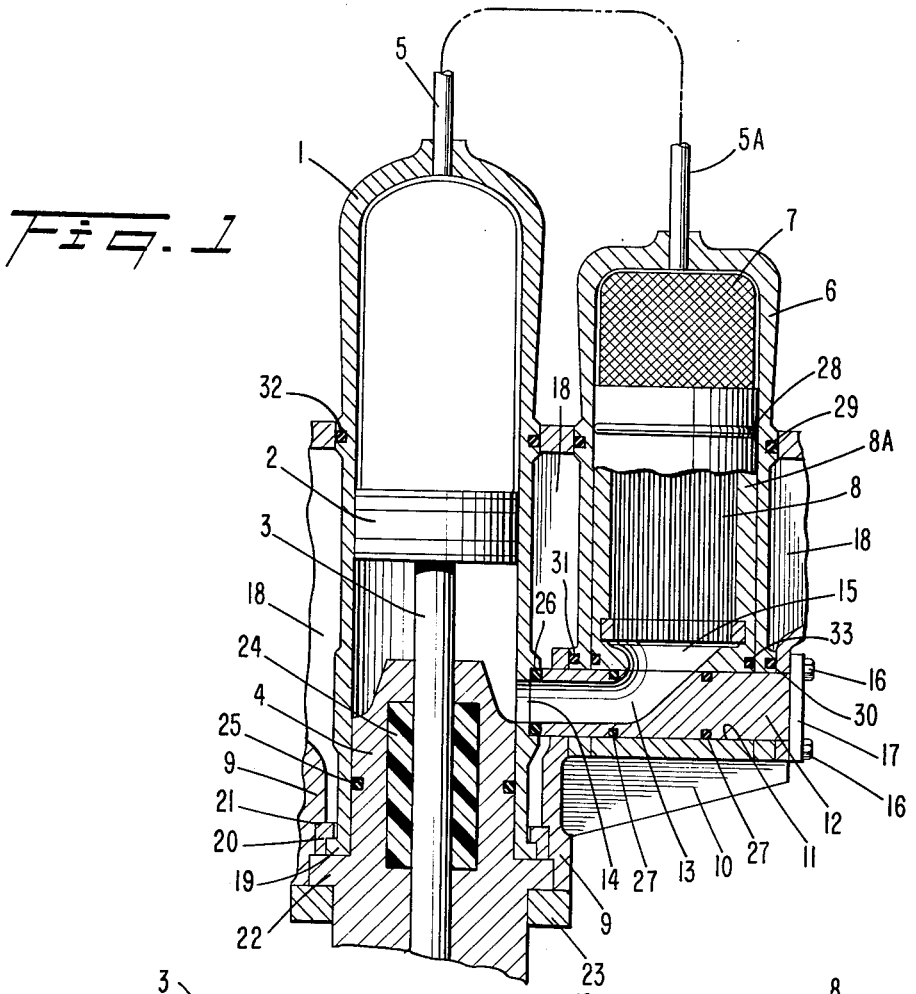
FIG. 1 is a vertical section through the major working gas-containing elements of a hot gas engine designed according to the invention.

Referring to FIG. 1, a cylinder 1 of a multi-cylinder hot gas engine contains a piston 2 slidably mounted therein. Piston 2 is connected to a piston rod 3 which passes through a sealing element 4. The lower end (not shown) of the piston rod 3 is connected to a crosshead and a connecting rod in a conventional manner. The upper end of the cylinder 1 is connected to a number of heater pipes, only one of which is shown and designated by the numeral 5. As is known in the art, a plurality of heater pipes form a heater pipe system. The other end of the pipe 5 (and of the other pipes not shown) is connected to the top of a regenerator-cooler housing (not shown) corresponding to the cylinder 1. The hot gas engine is comprised of a plurality of cylinders of the type shown. The end of a heater pipe **5*a* interconnects another such cylinder (not shown) to the top of its corresponding regenerator-cooler housing 6**.

Regenerator-cooler housing 6 contains a regenerator element 7 and a cooler unit 8 mounted in a cooler unit sleeve **8*a*. Each cylinder of the hot gas engine has a corresponding regenerator-cooler housing including a regenerator element 7 and a cooler element 8**.

The hot gas engine of the present invention includes an engine block 9 which is provided with a bracket 10 having an axial bore 11. A transverse bore 38 is formed in the lower portion of the regenerator-cooler housing 16, and a transverse bore 39 is formed in sleeve **8*a* of the cooler unit 8. Bores 11, 38 and 39** are coaxial.

Axial bore 11 is adapted to receive a locking pin 12 which in its locking position, as shown in FIG. 1, passes through bore 11 and transversely extending bores 38 and 39. The locking pin 12 serves to lock the regenerator-cooler housing 6, the cooler unit 8 and the engine block 9 with respect to each other. Locking pin 12 is provided with a cold gas connecting duct 13 providing communication between side opening 14 at the lower end of cylinder 1 and the interior space 15 of the cooler unit 8. A cover 17 and screws 16 secure locking pin 12 to bracket 10.

Lower parts of cylinder 1 and regenerator-cooler housing 6 are surrounded by a cooling water jacket including cavities 18.

A cylinder, its corresponding regenerator-cooler housing and the interconnecting heater pipes form a monoblock. A plurality of these monoblocks are inserted into the engine block to form the hot gas engine. A locking pin 12 passes through the regenerator-cooler housing 6 and the cooler unit sleeve **8*a* of one monoblock and abuts against the cylinder 1 of another monoblock. The cover 17 prevents the locking pin 12 from moving axially in one direction and the cylinder 1 prevents the locking pin 12** from moving axially in the other direction.

Cylinder 1 is provided with a small flange 19 at its lower end. A ring 20, consisting of a plurality of loose segments, is clamped between flange 19 and a shoulder surface 21 on the engine block 9. A flange 22 on the sealing element 4 is clamped between a flange 23 of the crankcase (otherwise not shown) and the end surface of the cylinder 1.

The working gas charges of the hot gas engine are contained by the interior faces of the monoblocks, the sealing element 4 and the locking pin 12. Additionally, the hot gas engine includes a number of seals. Seal 24 prevents leakage of gas between the piston rod 3 and the sealing element 4. An O-ring 25 prevents leakage of gas between the sealing element 4 and the inner wall of cylinder 1. Similarly, an O-ring 26 prevents leakage of gas between the abutting surfaces of the cylinder 1 and the locking pin 12. Two O-rings 27 form a seal between the locking pin 12 and the cooler unit 8. An O-ring 28 forms a seal between the cooler unit 8 and the inner wall of the regenerator-cooler housing 6. Finally, other O-rings 29–33 seal against leakage of cooling water.

In a four-cylinder hot gas engine the mounting of the working gas-containing components is carried out as follows. Initially, four monoblocks, each consisting of a cylinder, a regenerator-cooler housing and connecting heater pipes, are inserted into corresponding cavities formed in the engine block. Subsequently, the piston 2, piston rod 3 and the sealing element 4 are inserted into the cylinder. The ring segments 20 are then inserted between the sealing element 4 and the engine block 9. The crankcase 23 is then secured to the engine block 9. Subsequently, the regenerator elements 7 and the cooler units 8 are inserted into the regenerator-cooler housing 6. Finally, the locking pins 12 are passed through bores 11 in the brackets 10 and the transverse bores in the regenerator-cooler housing 6 and the cooler unit 8. The locking pins 12 are secured to the engine block 9 by cover 17 and screws 16.

As a result of the design and assembly of the present invention, the working gas of the hot gas engine is essentially contained by the monoblocks, the sealing element and the locking pin. Practically no additional elements are required. Furthermore, the design shown has the additional advantage that it is possible to replace separately the regenerator and the cooler units without removing the monoblocks.

Figure 2:
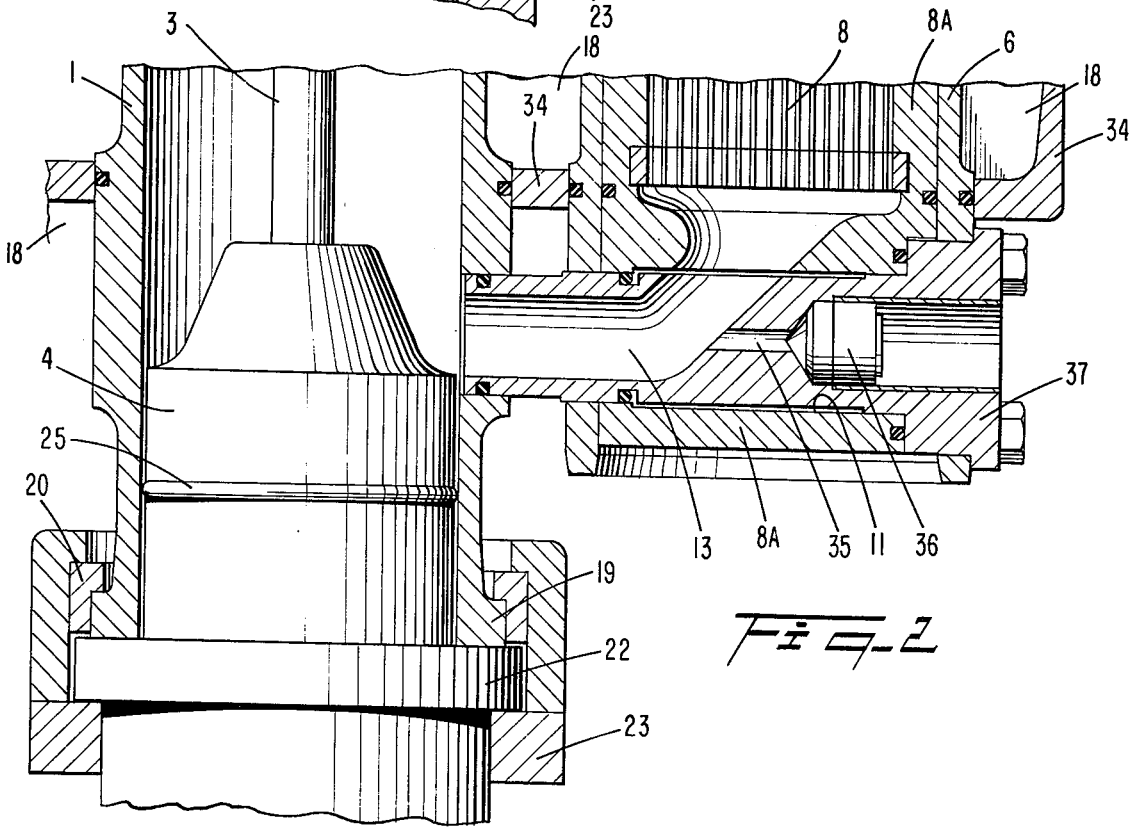
FIG. 2 is a vertical section through a portion of a hot gas engine and illustrates another embodiment of the invention.

The embodiment of FIG. 2 differs from that of FIG. 1 in that the locking pin 37 only passes through holes in the regenerator-cooler housing 6 and cooler unit 8 and not through a sleeve in the engine block. The locking pin 37 shown in FIG. 2, therefore, does not serve to secure the monoblocks to an engine block.

The monoblocks of the embodiment of FIG. 2 are held in their desired relative positions by the locking pin 37, by the flanges 23 of the crankcase and by cooling water jackets 34. The locking pin 37 of FIG. 2 is provided with an axial bore 35 communicating with cold gas connecting duct 13 and leading to a check valve 36 allowing flow of gas only outwardly from the cold gas connecting duct 13. In hot gas engine power control systems, check valves are necessary. The mounting of a check valve in the locking pin 12 is advantageous because it is easily mounted in the locking pin 12 by conventional means and is readily accessible for routine maintenance or replacement.

Furthermore, utilizing the locking pin 12 for mounting the check valve 36 eliminates the need for additional parts which otherwise would be required to house the check valve and also eliminate the need for additional seals which would be required for those additional parts.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A hot gas engine having a plurality of monoblock assemblies, each monoblock assembly including a cylinder, a heater pipe system and a regenerator-cooler housing, said monoblock assembly being detachably connected to a crankcase, the improvement in the monoblock assembly comprising:

transversely directed, coaxial bores formed in the regenerator-cooler housing and a cooler unit received therein, a locking pin passing through said bores and locking the regenerator-cooler housing relative to said cooler unit, and a cold gas connecting duct in said locking pin for providing communication between the cylinder and the regenerator-cooler housing.

2. A hot gas engine having an engine block and a plurality of monoblock assemblies, each monoblock assembly including a cylinder, a heater pipe system and a regenerator-cooler housing, said monoblock assembly being detachably connected to a crankcase, the improvement in the monoblock assembly comprising:

a bore provided in the engine block, transversely directed, coaxial bores formed in the regenerator-cooler housing and a cooler unit received therein, a locking pin passing through said bores and locking the regenerator-cooler housing relative to said cooler unit, and a cold gas connecting duct in said locking pin for providing communication between the cylinder and the regenerator-cooler housing.

3. A hot gas engine having a plurality of monoblock assemblies, each monoblock assembly including a cylinder, a heater pipe system and a regenerator-cooler housing, said monoblock assembly being detachably connected to a crankcase, the improvement in the monoblock assembly comprising:

transversely directed, coaxial bores formed in the regenerator-cooler housing and a cooler unit received therein, a locking pin passing through said bores, locking the regenerator-cooler housing relative to said cooler unit and abutting against a cylinder of another monoblock, and a cold gas connecting duct in said locking pin for providing communication between the cylinder and the regenerator-cooler housing.

4. The improvement of claim 1 further comprising a check valve bore in said locking pin communicating at one end with said cold gas connecting duct, and a check valve secured to said locking pin at the opposite end of said check valve bore.

5. The improvement of claim 4 wherein said check valve only permits the flow of gas outwardly from said cold gas connecting duct.

6. The improvement of claim 1 wherein a piston rod sealing element is clamped between the cylinder of the monoblock and the crankcase.

7. The improvement of claim 4 wherein a flange is provided on the cylinder, a shoulder surface is provided on the engine block and ring segments are clamped between said flange and said shoulder surface.

8. A hot gas engine having a plurality of monoblock assemblies, each monoblock assembly including a cylinder, a heater pipe system and a regenerator-cooler housing, said monoblock assembly being detachably connected to a crankcase, the improvement in the monoblock assembly comprising:

transversely directed, coaxial bores formed in the regenerator-cooler housing and a cooler unit received therein and a locking pin passing through said bores and locking the regenerator-cooler housing relative to said cooler unit.

9. A hot gas engine having an engine block and a plurality of monoblock assemblies, each monoblock assembly including a cylinder, a heater pipe system and a regenerator-cooler housing, said monoblock assembly being detachably connected to a crankcase, the improvement in the monoblock assembly comprising:

a bore provided in the engine block, transversely directed, coaxial bores formed in the regenerator-cooler housing and a cooler unit received therein and a locking pin passing through said bores and locking the regenerator-cooler housing relative to said cooler unit.

10. A hot gas engine having a plurality of monoblock assemblies, each monoblock assembly including a cylinder, a heater pipe system and a regenerator-cooler housing, said monoblock assembly being detachably connected to a crankcase, the improvement in the monoblock assembly comprising:

transversely directed, coaxial bores formed in the regenerator-cooler housing and a cooler unit received therein and a locking pin passing through said bores, locking the regenerator-cooler housing relative to said cooler unit and abutting against a cylinder of another monoblock.

* * * * *